US007762324B2

(12) United States Patent
Clem

(10) Patent No.: US 7,762,324 B2
(45) Date of Patent: Jul. 27, 2010

(54) BYPASS CROSSOVER SUB SELECTOR FOR MULTI-ZONE FRACTURING PROCESSES

(75) Inventor: Nicholas J. Clem, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 327 days.

(21) Appl. No.: 11/999,374

(22) Filed: Dec. 4, 2007

(65) Prior Publication Data

US 2009/0139718 A1 Jun. 4, 2009

(51) Int. Cl.
*E21B 43/26* (2006.01)
*E21B 34/10* (2006.01)

(52) U.S. Cl. ..... 166/177.5; 166/308.1; 166/319; 166/331; 166/332.2

(58) Field of Classification Search ..... 166/308.1, 166/177.5, 319, 331, 332.2
See application file for complete search history.

(56) References Cited

U.S. PATENT DOCUMENTS

| | | | | |
|---|---|---|---|---|
| 6,155,342 | A | 12/2000 | Oneal | |
| 6,186,236 | B1 | 2/2001 | Cox | |
| 6,216,785 | B1 | 4/2001 | Achee, Jr. et al. | |
| 7,066,264 | B2 | 6/2006 | Bissonnette et al. | |
| 7,503,384 | B2 | 3/2009 | Coronado | |
| 2005/0279501 | A1* | 12/2005 | Surjaatmadja et al. | 166/278 |
| 2006/0191685 | A1 | 8/2006 | Coronado | |

OTHER PUBLICATIONS

Nicholas J. Clem, et al., Utilizing Computational Fluid Dynamics (CFD) Analysis as a Design Tool in Frac Packing Application to Improve Erosion Life, SPE Annual Technical Conference and Exhibition, Sep. 24-27, 2006, SPE 102209, Society of Petroleum Engineers, San Antonio, Texas, USA.

Henry Restarick, Horizontal Completion Options in Reservoirs With Sand Problems, Mar. 11, 1995, pp. 545-560, SPE 29831, Society of Petroleum Engineers, Inc., U.S.A.

Notification of Transmittal of the International Search Report and the Written Opinion of the International Searching Authority, Or the Declaration, Jun. 23, 2009, pp. 1-4, PCT/US2008/083929, Korean Intellectual Property Office.

International Search Report, Jun. 23, 2009, pp. 1-3, PCT/US2008/083929, Korean Intellectual Property Office.

(Continued)

*Primary Examiner*—Jennifer H Gay
*Assistant Examiner*—Brad Harcourt
(74) *Attorney, Agent, or Firm*—Greenberg Traurig LLP; Anthony F. Matheny

(57) ABSTRACT

Fracturing tools for fracturing multiple zones of a wellbore are disclosed. In certain embodiments, the fracturing tools comprise two or more crossover subs coupled together and having a crossover sub window alignment assembly operatively associated with either an isolation sleeve disposed within the bores of the crossover sub-assemblies or with the crossover sub assemblies themselves. Actuation of the crossover sub window alignment assembly opens and closes the windows of each of the crossover sub-assemblies so that different crossover sub-assemblies can be activated to fracture various wellbore locations.

22 Claims, 6 Drawing Sheets

OTHER PUBLICATIONS

Written Opinion of the International Searching Authority, Jun. 23, 2009, pp. 1-6, PCT/US2008/083929, Korean Intellectual Property Office.

E. Paul Bercegeay, A One-Trip Gravel Packing System, Feb. 7, 1974, pp. 1-12, SPE 4771, American Institute of Mining, Metallurgical, and Petroleum Engineers, Inc., U.S.A.

E. Harold Vickery, Application of One-Trip Multi-Zone Gravel Pack to Maximize Completion Efficiency, Oct. 12, 2000, pp. 1-10, SPE 64469, Society of Petroleum Engineers Inc., U.S.A.

Stephen P. Mathis, Sand Management: A Review of Approaches and Concerns, May 13, 2003, pp. 1-7, SPE 82240, Society of Petroleum Engineers Inc., U.S.A.

* cited by examiner

BYPASS CROSSOVER SUB SELECTOR FOR MULTI-ZONE FRACTURING PROCESSES

BACKGROUND

1. Field of Invention

The invention is directed to fracturing tools for use in oil and gas wells, and in particular, to fracturing tools having multiple crossover sub-assemblies or subs capable of being selected during multi-zone fracturing processes.

2. Description of Art

Fracturing or "frac" systems or tools are used in oil and gas wells for completing and increasing the production rate from the well. In deviated well bores, particularly those having longer lengths, fracturing fluids can be expected to be introduced into the linear, or horizontal, end portion of the well to frac the production zone to open up production fissures and pores therethrough. For example, hydraulic fracturing is a method of using pump rate and hydraulic pressure created by fracturing fluids to fracture or crack a subterranean formation.

In addition to cracking the formation, high permeability proppant, as compared to the permeability of the formation can be pumped into the fracture to prop open the cracks caused by a first hydraulic fracturing step. For purposes of this disclosure, the proppant is included in the definition of "fracturing fluids" and as part of well fracturing operations. When the applied pump rates and pressures are reduced or removed from the formation, the crack or fracture cannot close or heal completely because the high permeability proppant keeps the crack open. The propped crack or fracture provides a high permeability path connecting the producing wellbore to a larger formation area to enhance the production of hydrocarbons.

To facilitate fracturing of the well and returning wellbore fluids, including produced hydrocarbons, back to the surface of the well, some fracturing tools include a crossover sub-assembly or sub having two pathways. Proppant is pumped downhole through one pathway and into the formation and producing fluids are returned back uphole to the surface of the well through the other pathway. In multi-zone fracturing processes, the crossover sub is used repeatedly in each zone which can decrease the life of the crossover sub requiring repairs or replacements before the fracturing process is completed across each of the multi-zones.

SUMMARY OF INVENTION

Broadly, the fracturing tool includes two or more crossover sub-assemblies arranged in series, each of the crossover sub-assemblies having at least one window. The crossover subs are connected to one another by a coupling that provides bypass flow area communication between each crossover sub. The windows of each crossover sub may be inline with each other, i.e., one directly above or below the next window, or they may be circumferentially disposed around the circumference of the outer wall surfaces of each crossover subs' housing so that none of the windows occupy the same radial arc of the circumference of the outer wall surface of each crossover subs' housing, so that each window can be opened to allow flow therethrough in different radial directions around the circumference of the fracturing tool. Therefore, the wellbore can be fractured in different radial directions away from the fracturing tool without rotation of the crossover sub-assemblies. Alternatively, the windows may be disposed so that only a small amount one window overlaps the radial arc of the circumference of another window.

In one specific embodiment, an isolation sleeve having a plurality of windows straddled by seals is inserted into a bore of the crossover subs so that the windows are in phased-alignment with the location of port openings in the crossover subs. In other words, one window of the isolation sleeve may be initially aligned with a window in one of the crossover subs, however, the remaining windows in the isolation sleeve are not in alignment with any of the windows of the other crossover subs. To align a second window of the isolation sleeve with the window of a second crossover sub, either the isolation sleeve or the crossover sub assemblies is moved or rotated. In so doing, the initial alignment of one window of the isolation sleeve with the window of the first crossover sub is taken out of alignment, while a second isolation sleeve window is placed in alignment with the window of a second crossover sub. The isolation sleeve can be further moved or rotated to align each of the windows in the isolation sleeve with each of the corresponding windows of each subsequent crossover sleeve. This arrangement can provide that only one window of the isolation sleeve at time is in alignment with one window of a crossover sub. Alternatively, the isolation sleeve can be designed so that two or more isolation sleeve windows are simultaneously in alignment with their corresponding windows in multiple crossover subs.

The isolation sleeve may be moved or rotated using any mechanism or actuator desired. In one specific embodiment, the isolation sleeve is connected to a rotation mechanism comprising a J-hook mechanism below the lower most crossover sub. Pressure applied from the surface shifts the isolation sleeve down while the J-hook mechanism changes the phasing of the windows in the sleeve. A return member, such as a spring, pushes the sleeve back to its starting position and, in so doing, aligns a window of a different crossover sub with a port opening. Subsequent crossover subs are moved into and out of operation in the same manner.

Instead of a J-hook mechanism, the crossover subs may be phased into and out of operation through linear translation by itself, or in combination with the J-hook mechanism.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Figure 1:
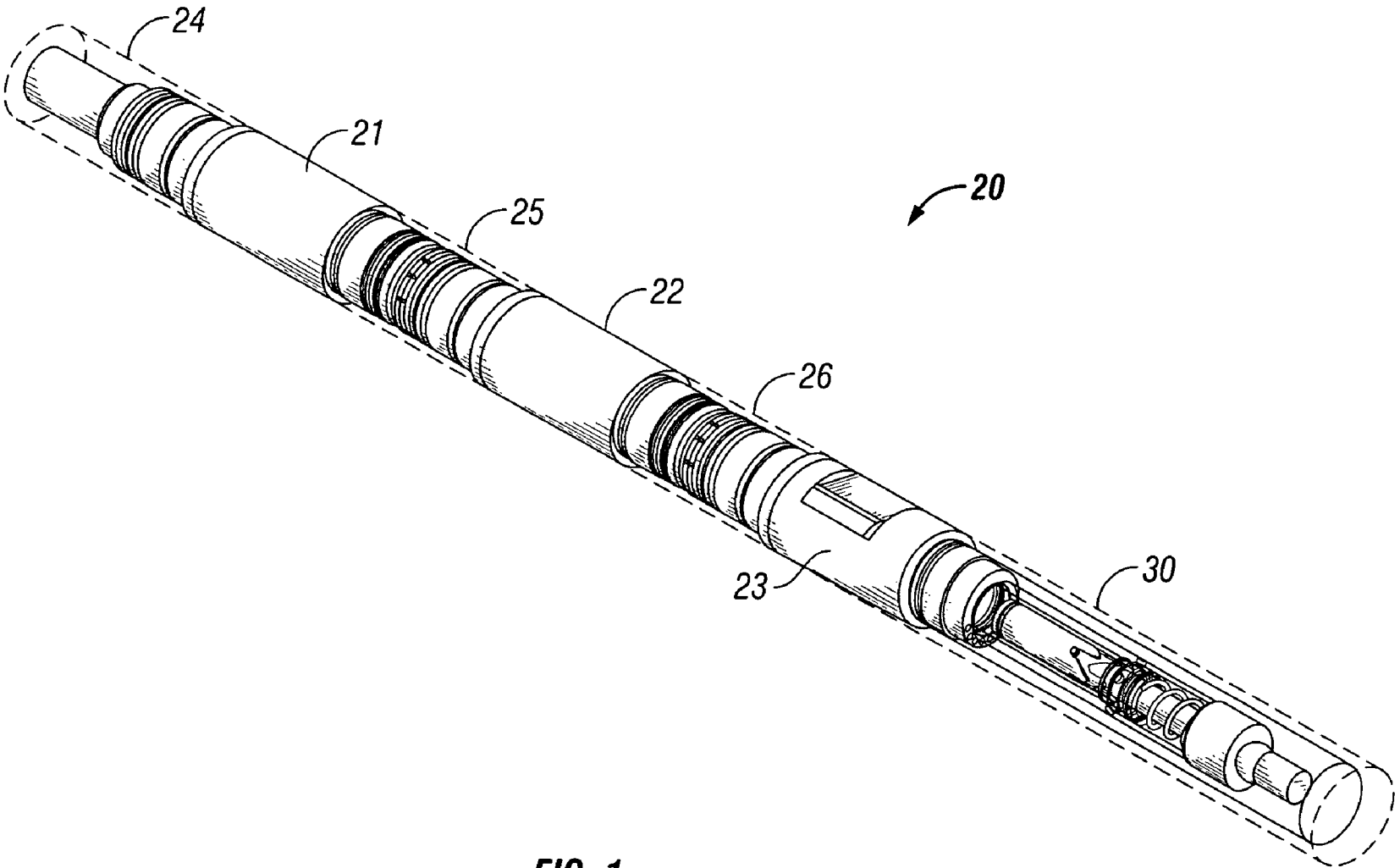
FIG. 1 is a perspective view of one specific embodiment of a fracturing tool disclosed herein.

Referring now to FIGS. 1-4C, in one specific embodiment, fracturing tool 20 comprises three crossover subs 21, 22, 23. The upper end of fracturing tool 20 includes coupler 24 (shown in dashed lines) for releasably connecting the uppermost crossover sub 21 to tubing (not shown) or the rest of the service tool (not shown) which is then connected to tubing (not shown). The uppermost crossover sub 21 is releasably connected to the middle crossover sub 22 by coupler 25 (shown in dashed lines) and the lowermost crossover sub 23 is releasably connected to the middle crossover sub 22 by coupler 26 (shown in dashed lines). As discussed in greater detail below, crossover subs 21, 22, 23 and couplers 25, 26 are arranged so that the widows or ports of each crossover sub are "phased." In other words, each window opens, i.e., places the bore of each crossover sub in fluid communication with the outside environment, e.g., the annulus of the wellbore (not shown) into which fracturing tool 20 is disposed for operation, in a different direction heading along the circumference of fracturing tool 20. For example, fracturing tool 20 may have uppermost crossover sub 21 with a window disposed at 120 degrees, middle crossover sub 22 with a window disposed at 240 degrees, and lowermost crossover sub 23 with a window disposed at 360 degrees so that each window is located 120 degrees away from the other two windows. Because of the phased alignment of the windows of crossover subs 21, 22, 23, the only window shown in FIG. 1 is window 27 of lowermost crossover sub 23. Window 28 of uppermost crossover sub 21 is illustrated in FIG. 3A and the window of middle crossover sub 22 is not shown.

Although fracturing tool 20 is shown in the embodiment of FIGS. 1-4C as comprising three crossover subs, it is to be understood that fracturing tool 20 may comprise two crossover subs, or more than three crossover subs, depending on the number fracturing operations and number of zones desired to fracture using fracturing tool 20 during one run in the wellbore.

Releasably connected to lowermost crossover sub 23 is crossover sub window alignment assembly 30 (shown in dashed lines) which is discussed in greater detail below.

Figure 2A:
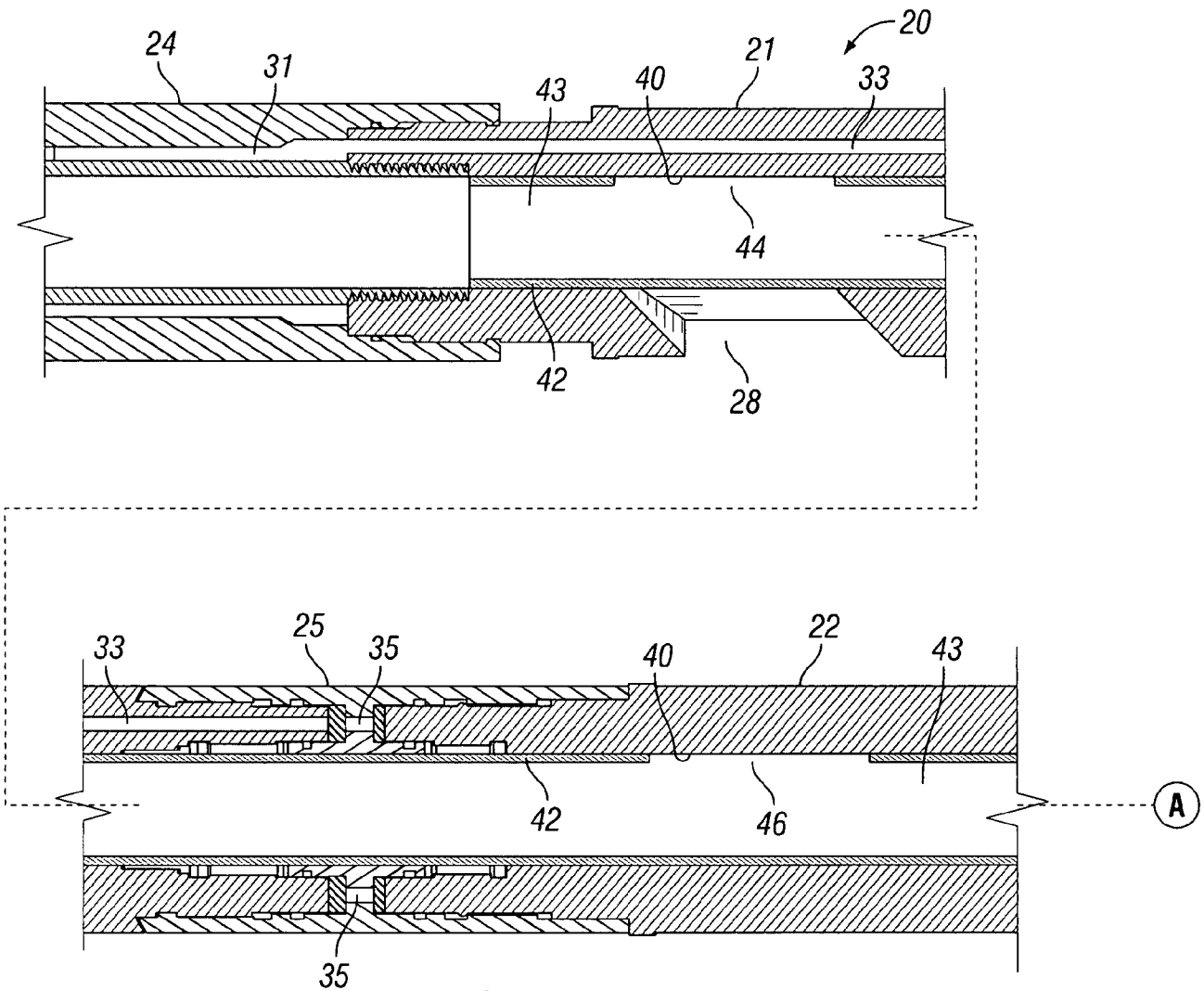
FIGS. 2A-2B are partial cross-sectional views of the fracturing tool shown in FIG. I in which the upper end is to the left and the lower end is to the right, so that upward movement refers to movement to the left and downward movement refers to movement to the right.
Figure 2B:
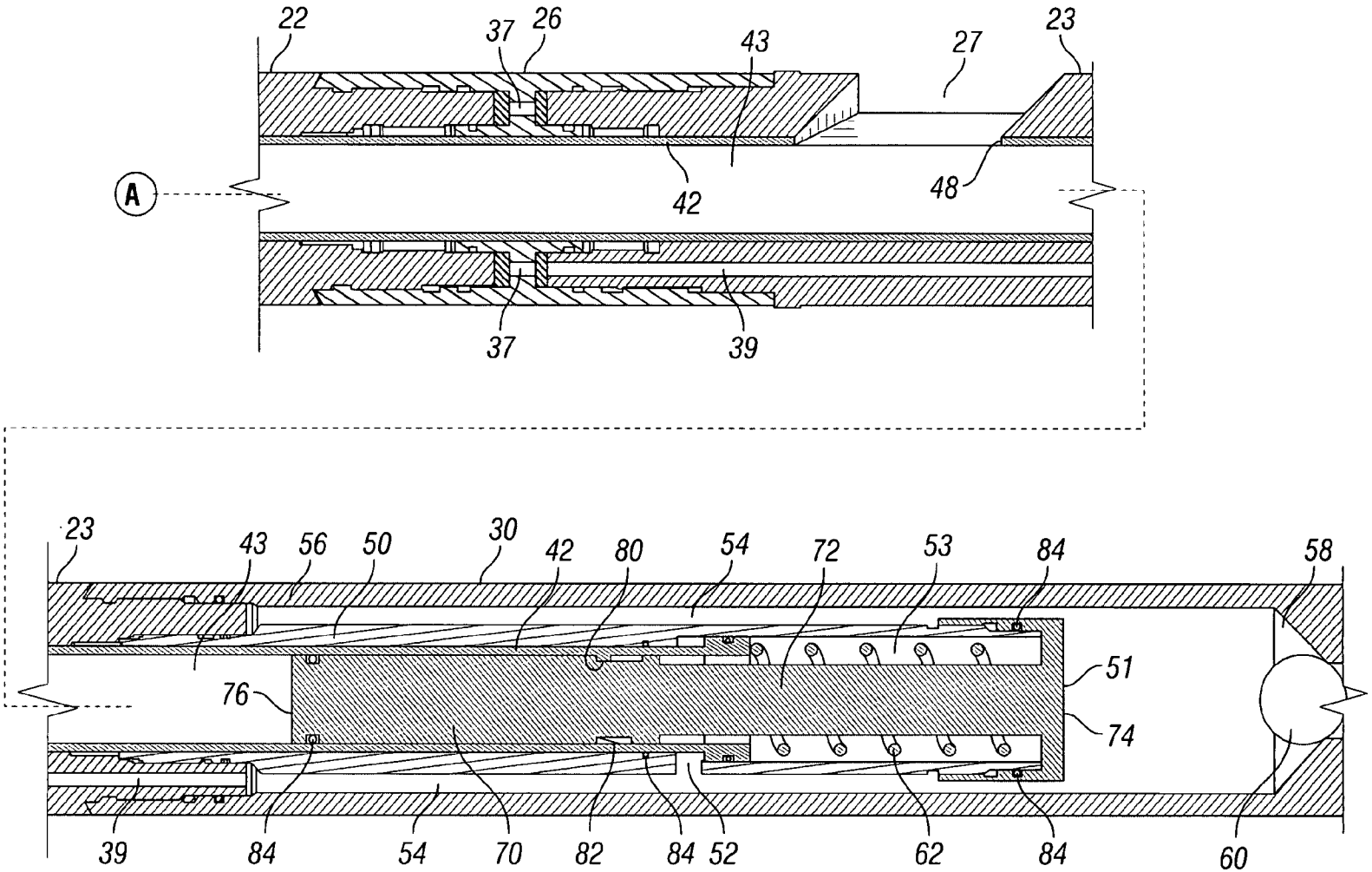

Referring now to FIGS. 2A-2B, coupler 26 is releasably secured to the upper end of uppermost crossover sub 21. Coupler 26 includes annulus 31 in fluid communication with fluid path 33 of uppermost crossover sub 21. Fluid path 33 is disposed within the housing of uppermost crossover sub 21. Fluid path 33 is in fluid communication with coupler fluid path 35 within coupler 25. Coupler fluid path 35 is disposed within the housing of coupler 25 so as to place fluid path 33 in fluid communication with a fluid path of middle crossover sub 22 (not shown). The fluid path of middle crossover sub 22 is referred to herein as the middle crossover sub fluid path. Coupler fluid path 35 is circumferentially disposed within the housing; however, coupler fluid path 35 is not required to form a circle, i.e., it is not required to travel a full 360 degrees within the housing of coupler 25. In one specific embodiment, coupler fluid path 35 travels 180 degrees or less within the housing of coupler 25.

The middle crossover sub fluid path and lowermost crossover sub fluid path 39 are in fluid communication with coupler fluid path 37 within coupler 26 so as to place annulus 31, fluid path 33, coupler fluid path 35, middle crossover sub fluid path, and lowermost crossover sub fluid path 39 all in fluid communication with each other. Coupler fluid path 37 is disposed within the housing of coupler 26 in the same manner as coupler fluid path 35 discussed above.

Figure 4A:
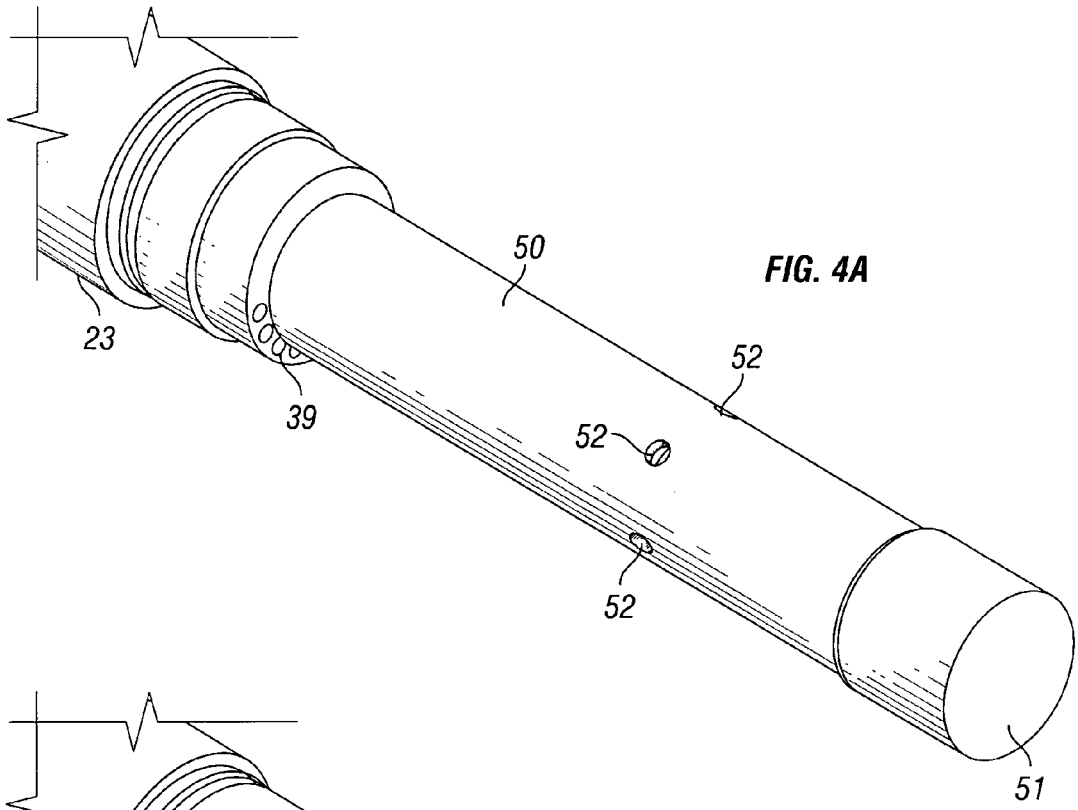
FIG. 4A is a partial perspective view of the isolation sleeve actuator of FIG. 2 in which the outer housing has been removed to better illustrate the J-hook mechanism housing.
Figure 4B:
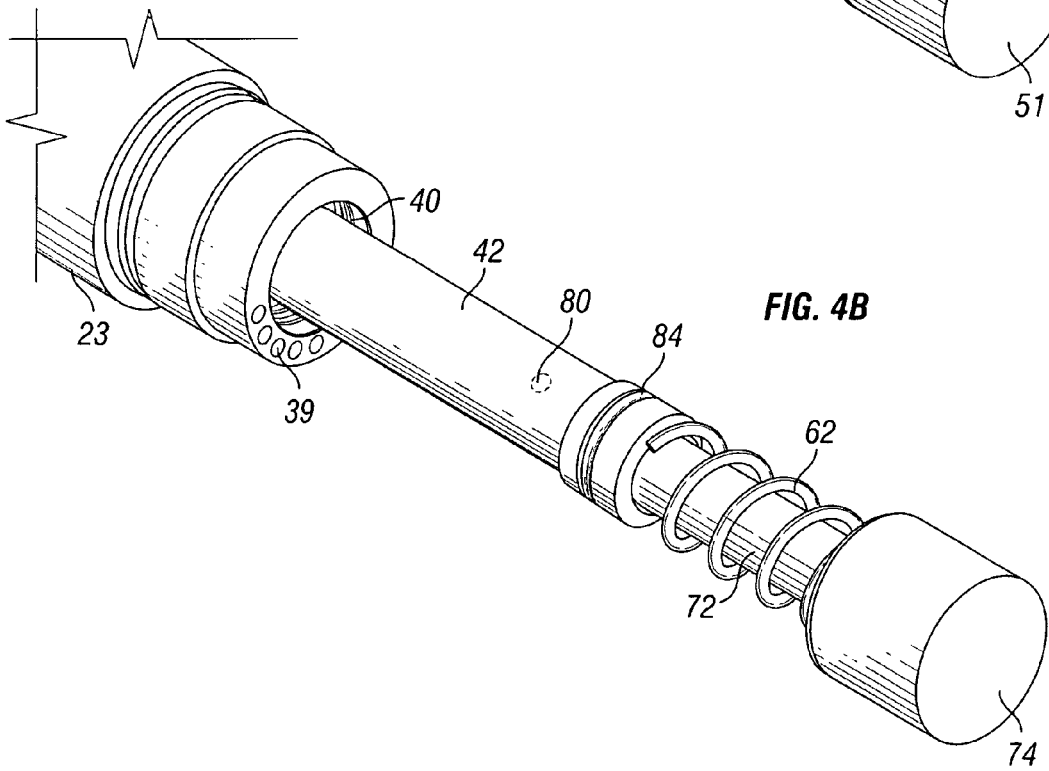
FIG. 4B is a partial perspective view of the isolation sleeve actuator of FIG. 2 in which the outer housing and the J-hook mechanism housing have been removed to better illustrate the isolation sleeve.
Figure 4C:
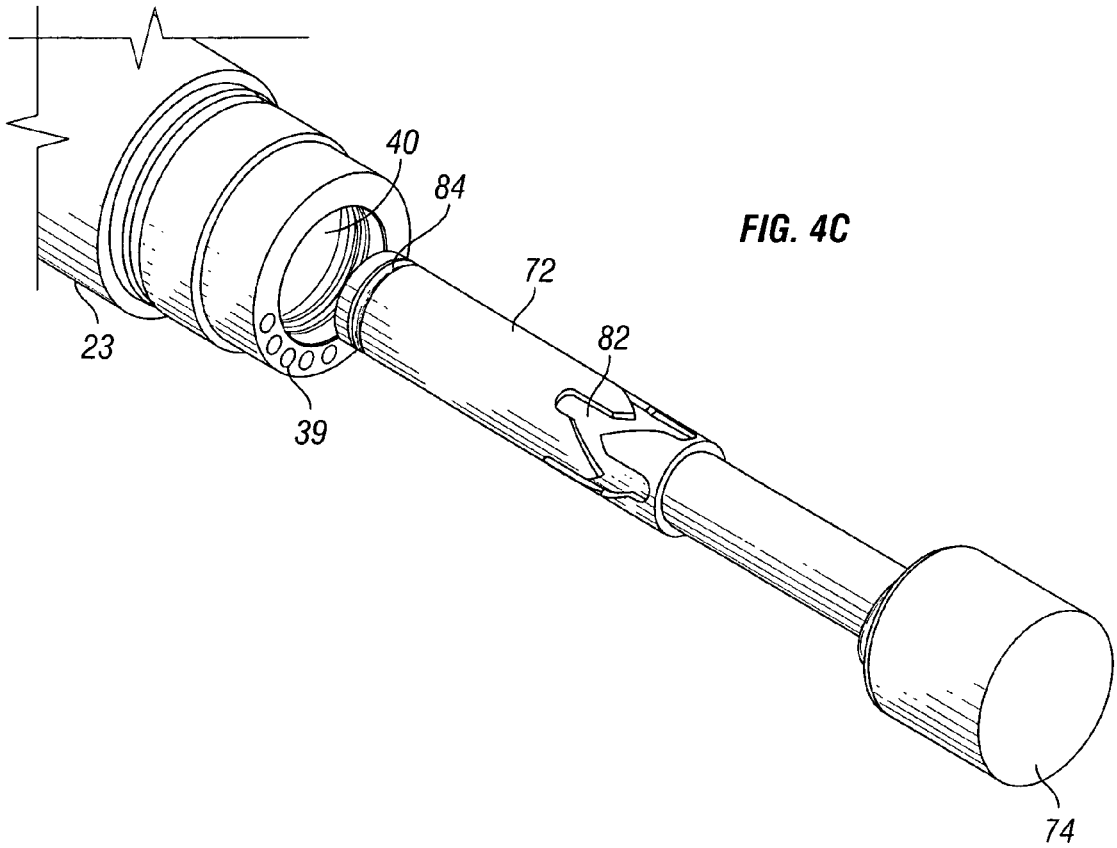
FIG. 4C is a partial perspective view of the isolation sleeve actuator of FIG. 2 in which the outer housing, the J-hook mechanism housing, and the isolation sleeve have been removed to illustrate the J-hook mechanism.

As illustrated in FIGS. 4A-4C, fluid path 39 comprises a plurality of pathways. It is to be understood however, that fluid path 39 may comprise only one pathway. Likewise, one or more of annulus 31, fluid path 33, and/or the middle crossover sub fluid path, may be comprised of several different pathways or a single pathway.

Crossover subs 21, 22, 23 and couplers 25, 26 each include a bore defined by an inner wall surface of each of crossover subs 21, 22, 23, and couplers 25, 26. The bores of crossover subs 21, 22, 23 and couplers 25, 26 are in fluid communication with each other to form a single central bore 40. Thus, once assembled, crossover subs 21, 22, 23 have two fluid pathways: central bore 40 and the fluid pathway formed by annulus 31, fluid path 33, coupler fluid path 35, middle crossover sub fluid path (not shown), coupler fluid path 37, and fluid path 39.

Isolation sleeve 42 comprises isolation sleeve bore 43 and is disposed within central bore 40. Isolation sleeve 42 is in sliding engagement with the inner wall surface of central bore 40 so that isolation sleeve 42 an be manipulated to open and close fluid communication between isolation sleeve bore 43 and the windows of crossover subs 21, 22, 23. Isolation sleeve 42 includes at least one port or window that can be aligned with the windows of each crossover sub 21, 22, 23. In the embodiment shown in FIGS. 1-4C, there are three windows 44, 46, 48. In the embodiment shown, windows 44, 46, 48 are not phased in the same manner as the windows of crossover subs 21, 22, 23, but instead are disposed one above the other along the same arc of the circumference of isolation sleeve 42. Due to windows 44, 46, 48 not being phased identically to the phasing of the windows in crossover subs 21, 22, 23, only one window of crossover subs 21, 22, 23 at a time can be placed in fluid communication with isolation sleeve bore 43.

Figure 3:
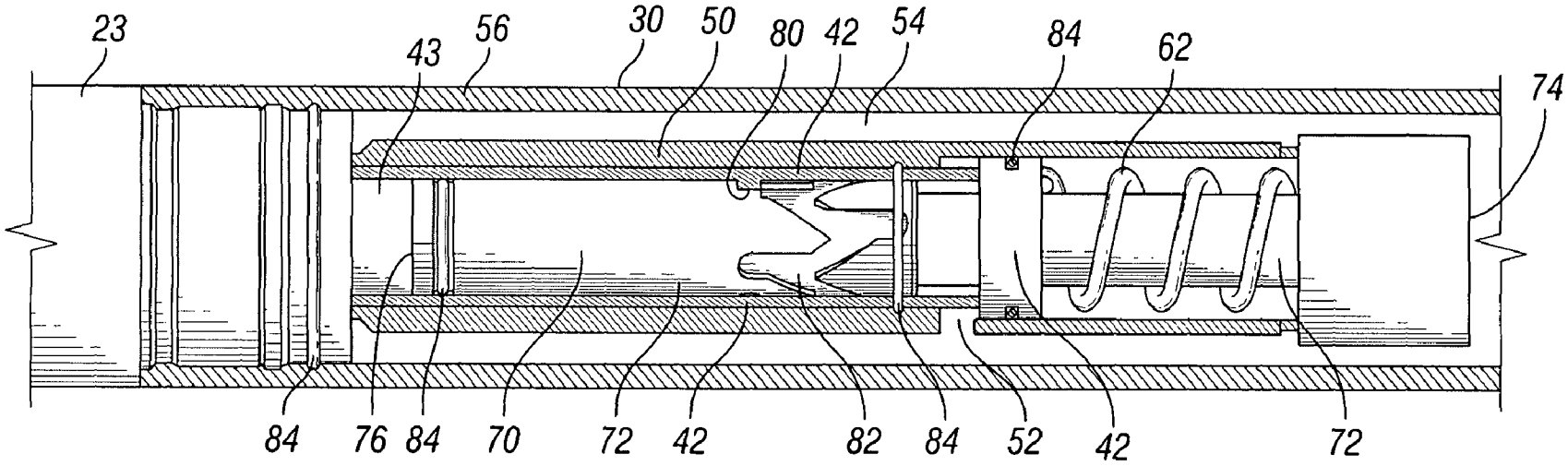
FIG. 3 is a detailed partial cross-sectional view of one specific crossover sub window alignment assembly to facilitate movement of the isolation sleeve of the fracturing tool shown in FIG. 1 in which the upper end is to the left and the lower end is to the right, so that upward movement refers to movement to the left and downward movement refers to movement to the right.

As illustrated in FIGS. 2B and 3, isolation sleeve 42 is operatively associated with crossover sub window alignment assembly 30. Crossover sub window alignment assembly 30 is used to manipulate isolation sleeve 42 to the desired orientation so that the window of the desired crossover sub is placed in fluid communication with isolation sleeve bore 43. As noted above, in the specific embodiment illustrated in the Figures, only one window of one crossover sub at a time is placed in fluid communication with central bore 40. However, if desired, isolation sleeve 42 can be designed to simultaneously place two or more windows of two or more crossover subs in fluid communication with isolation sleeve bore 43.

In one particular embodiment, crossover sub window alignment assembly 30 comprises a lower portion of isolation sleeve 42 extending from the lower end of lowermost crossover sub 23. Operatively associated with this lower portion of isolation sleeve 42 is an actuator to facilitate axial movement of isolation sleeve. In the particular embodiment shown in FIGS. 2A-4C, the actuator comprises a piston head in sliding engagement with isolation sleeve housing 50 which is closed off at its lower end 51 to form chamber 53. To facilitate axial movement of isolation sleeve 42, isolation sleeve housing 50 includes one more ports 52 to allow fluid to flow above the piston head (to the left of piston head as shown in the Figures) to force the piston head downward (to the right as shown in the Figures). The fluid pressure to force the piston head downward is controlled from the surface of the well by pumping fluid down annulus 31 and through fluid path 33, coupler fluid path 35, middle crossover sub fluid path (not shown), coupler fluid path 37, and fluid path 39 into chamber 54 formed by the outer wall surface of isolation sleeve housing 50 and the inner wall surface of crossover sub window alignment assembly housing 56. In one specific embodiment, chamber 54 includes at its lower end a one-way check valve 58 having ball 60 to facilitate fluid pressure to be increased within chamber 54 so that the piston head can be forced downward and isolation sleeve 42 can be moved axially.

As noted above, isolation sleeve housing 50 forms chamber 53 between the lower end of isolation sleeve 42, i.e., the piston head, and the lower end 51 of isolation sleeve housing 50. A return member, such as coiled spring 62, may be disposed within cavity 53. The return member facilitates axial movement of isolation sleeve in an upward direction. Although the return member is shown as a coiled spring, it is to be understood that return member may be any device that can be energized by fluid pressure acting downward on the piston head and, after the fluid pressure is reduced, can release sufficient energy to assist upward movement of the piston head and, thus, upward movement of isolation sleeve 42. For example, return member may be an elastomeric material or may be fluid maintained within chamber 53 at atmospheric pressure.

In addition to axially moving isolation sleeve 42, crossover sub window alignment assembly 30 in the embodiments shown in FIGS. 2B-4C also provides for rotating isolation sleeve 42. Rotation of isolation sleeve 42 is accomplished in this specific embodiment by use of rotation mechanism 70 comprising shaft 72 having lower end 74 and upper end 76. Upper end 76 is inserted into isolation sleeve bore 43 and, thus, through the piston head, so that the inner wall surface of isolation sleeve 42 is in sliding engagement with shaft 72. Lower end 74 is releasably connected to isolation sleeve housing 50 such as through threads (not shown). In this embodiment, lower end 74 of shaft 72 forms cavity 53 within isolation sleeve housing 50 between the lower end of isolation sleeve 42 and lower end 74 of shaft 72.

Shaft 72 and isolation sleeve 42 include a J-hook mechanism in which the inner wall surface of isolation sleeve 42 includes one or more pegs 80 extending inwardly into isolation sleeve bore 43 and shaft 72 comprises J-hook profile 82 circumferentially disposed around the outer wall surface of shaft 72. Each peg 80 is operatively associated with J-hook profile 82 to operate as a J-hook assembly.

To reduce leakage of fluids between releasably connected and slidingly engaged components of fracturing tool 20, seals 84 are included.

In another embodiment, crossover sub window alignment assembly 30 comprises a lower portion of isolation sleeve 42 extending from the lower end of lowermost crossover sub 23. As with the embodiment described above, operatively associated with this lower portion of isolation sleeve 42 is an actuator to facilitate axial movement of isolation sleeve. This axial movement of isolation sleeve 42 can, in certain embodiments, be all that is need to move isolation sleeve 42 from one orientation, e.g., in which isolation sleeve window 46 is aligned with window 27 of uppermost crossover sub 21, to a second orientation, e.g., in which isolation sleeve window 47 is aligned with the window (not shown) of middle crossover sub 22. In this specific embodiment, rotation of isolation sleeve 42 is not required for fracturing tool 20 to operate.

In operation, fracturing tool 20 is assembled having two or more crossover subs connected to each other by at least one coupler. Isolation sleeve 42 is disposed within the bore of the crossover subs and the coupler(s) and a crossover sub window alignment assembly 30 is secured to the lowermost crossover sub. The uppermost crossovers sub can be secured to the rest of the service tool which is then attached to tubing and the tubing string is then lowered into a wellbore of a well until it is disposed at the desired location to fracture the wellbore.

Initially, each of the windows of the crossover subs is closed off by isolation sleeve 42; however, it is to be understood that one or more of the windows of the crossover subs may be opened during run-in.

After fracturing tool 20 reaches the desired location with the wellbore, fluid (not shown) is pumped down the tubing string into annulus 31 and through fluid path 33, coupler fluid path 35, middle crossover sub fluid path (not shown), coupler fluid path 37, and fluid path 39 and into chamber 54. The fluid enters port 52 and begins to build up pressure due to one-way check valve 58 closing. As the fluid pressure builds, the actuator, e.g., piston head, is activated and isolation sleeve 42 begins to move axially downward. In so doing, one or more windows in isolation sleeve 42 is placed in alignment with one or more windows of one or more crossover sub so that isolation sleeve bore 43 is in fluid communication with the wellbore environment so that proppant can be injected into the wellbore formation.

Upon completion of the fracturing of the wellbore formation, the fluid pressure exerted into annulus 31 and through fluid path 33, coupler fluid path 35, middle crossover sub fluid path (not shown), coupler fluid path 37, and fluid path 39 and into chamber 54 is decreased. As a result, isolation sleeve 42 is permitted to move axially upward to close one or more of the windows of one or more of the crossover subs.

In one particular embodiment, a return member is operatively associated with the lower end of isolation sleeve 42 to facilitate movement of isolation sleeve 42 axially upward.

In another particular embodiment, the fluid pressure built up moves isolation sleeve 42 axially downward. In so doing, peg 80 disposed within J-hook profile 82 is slid along J-hook profile 82 causing isolation sleeve 42 to begin rotating. At a point of time determined by the axial length of each J-hook profile groove, downward axial movement is restricted by peg 80 contacting the lowest point in the axial length of each J-hook profile groove, regardless of the level of fluid pressure causing axially movement downward. The fluid pressure can then be decreased, allowing isolation sleeve 42 to move upward. As isolation sleeve 42 moves upward, isolation sleeve continues rotating in the same direction as when the fluid pressure was causing axially movement downward. As a result, isolation sleeve 42 is rotated (even if isolation sleeve is returned to its original axial location within fracturing tool 30), to place one or more windows in isolation sleeve 42 in alignment, or out of alignment, with one or more windows of one or more crossover subs. In other words, rotation of isolation sleeve 42 opens and closes each of the windows in each of the crossover subs.

In another operation of fracturing tool 20, each of the windows of the crossover subs is initially closed. Fracturing tool 20 is disposed within wellbore and fluid pressure is built up within chamber 54 in the same manner as described above so that isolation sleeve 42 moves axially downward and is rotated by rotation mechanism 70, such as by use of peg(s) 80 and J-hook profile 82 described above. The first cycle of increasing and decreasing fluid pressure rotates isolation sleeve 42 to place a first window of one crossover sub in fluid communication with isolation sleeve bore 43. Proppant is ejected from isolation sleeve bore 43, through the first window, and into the formation. Proppant ejection is then reduced and fluid pressure is again exerted into annulus 31 and through fluid path 33, coupler fluid path 35, middle crossover sub fluid path (not shown), coupler fluid path 37, and fluid path 39 and into chamber 54. As a result, isolation sleeve 42 is rotated in the same manner as described above so that the first window is closed and a second window in the same or different crossover tool is opened. Proppant is again ejected from isolation sleeve bore 43, through the second window, and into the formation to fracturing a second zone of the wellbore. This process can be repeated to fracture multiple zones disposed adjacent each of the windows in each of the crossover subs.

After all of the fracturing operations have been completed, isolation sleeve can be rotated so that each of the windows in each of the crossover subs is closed and fracturing tool 20 can be removed from the wellbore.

It is to be understood that the invention is not limited to the exact details of construction, operation, exact materials, or embodiments shown and described, as modifications and equivalents will be apparent to one skilled in the art. For example, isolation sleeve may be moved to close one window in one crossover sub and open another window in a second crossover sub by rotating isolation sleeve, axially moving isolation sleeve, or a combination of axially moving and rotating isolation sleeve. Additionally, shaft 72 may be solid (as shown) or include a bore. Moreover, rotation mechanism 70 may comprise J-hook profile 82 disposed on the inner wall surface of isolation sleeve 42 and one or more pegs 80 extending outwardly from the outer wall surface of shaft 72. This J-hook arrangement and the J-hook arrangement discussed above are collectively referred to herein as "J-hook mechanisms." Alternatively, rotation mechanism 70 may comprise profiles on both the inner wall surface of isolation sleeve 42 and on the outer wall surface of shaft as long as the two profiles are operatively associated with each other so that rotation of isolation sleeve 42 can be accomplished during one or both of fluid pressure increase and decrease within chamber 54. Further, the connections of each of the components of the fracturing tools disclosed herein may be made by threads or any other connecting mechanism. In addition, instead of the isolation sleeve being actuated, e.g., moved or rotated, to place the isolation sleeve windows in alignment with the crossover sub-assembly windows, the crossover sub-assemblies may be actuated to move or rotate to provide the alignment of the isolation sleeve windows with the corresponding crossover sub-assembly windows. Moreover, the windows of the crossover sub-assemblies may be inline with each, or they may be disposed around the circumference of the fracturing tool so that no windows open along the same radial arc of the circumference of the fracturing tool or so that only a small portion of one or more windows overlaps the radial arc of the circumference of another window. Accordingly, the invention is therefore to be limited only by the scope of the appended claims.

What is claimed is:

1. A fracturing tool comprising:

a first crossover sub-assembly comprising a first crossover bore and a first window in fluid communication with the first crossover bore;

a second crossover sub-assembly comprising a second crossover bore and a second window in fluid communication with the second crossover bore, the second crossover bore being in fluid communication with the first crossover bore and the first window being in phased alignment with the second window;

an isolation sleeve disposed within the first and second crossover bores, the isolation sleeve comprising an isolation sleeve bore and at least one isolation sleeve window; and a crossover sub window alignment assembly operatively associated with the isolation sleeve, the crossover sub window alignment assembly causing placement of the first and second windows in fluid communication with the isolation sleeve window, wherein the crossover sub window alignment assembly comprises an outer housing defining a fluid chamber, an actuator housing defining an actuator housing chamber, the actuator housing having at least one port placing the fluid chamber in fluid communication with the actuator housing chamber, and a fluid actuatable actuator disposed within the actuator housing.

2. The fracturing tool of claim 1, wherein the fluid actuatable actuator comprises a piston disposed at a lower end of the isolation sleeve, the piston head being in sliding engagement with an inner wall surface of the actuator housing.

3. The fracturing tool of claim 1, wherein the crossover sub window alignment assembly further comprises a rotation mechanism operatively associated with the actuator.

4. The fracturing tool of claim 3, wherein the rotation mechanism further comprises a shaft in sliding engagement with an inner wall surface of the isolation sleeve bore.

5. The fracturing tool of claim 4, wherein the rotation mechanism comprises a J-hook mechanism.

6. The fracturing tool of claim 5, wherein the J-hook mechanism comprises a peg extending inwardly from the inner wall surface of the isolation sleeve bore and a J-hook profile circumferentially disposed along an outer wall surface of the shaft.

7. The fracturing tool of claim 6, wherein the crossover sub window alignment assembly further comprises a return member.

8. The fracturing tool of claim 7, wherein the return member is a coiled spring.

9. The fracturing tool of claim 8, wherein the fluid chamber comprises a one-way check valve operatively associated therewith.

10. The fracturing tool of claim 1, wherein the actuator housing chamber is divided by the actuator into an upper chamber and a lower chamber, the upper chamber comprising a return member, the return member comprising an atmospheric chamber, and the lower chamber being in fluid communication with the fluid chamber.

11. A fracturing tool comprising:

at least two crossover sub-assemblies in fluid communication with each other, each of the at least two crossover sub-assemblies comprising a crossover bore and at least one window;

an isolation sleeve disposed within the crossover bores of each of the crossover sub-assemblies, the isolation sleeve comprising an isolation sleeve bore and at least one isolation sleeve window; and a crossover sub window alignment assembly operatively associated with the isolation sleeve, the crossover sub window alignment assembly causing placement of at least one of the windows of the crossover sub-assemblies in fluid communication with the isolation sleeve window, wherein the isolation sleeve comprises an actuator operatively disposed at a lower end of the isolation sleeve and the crossover sub window alignment assembly comprising a chamber in fluid communication with the actuator so that fluid pressure within the chamber actuates the actuator to cause the isolation sleeve to place at least one of the windows of the crossover sub-assembly in fluid communication with the isolation sleeve window.

12. The fracturing tool of claim 11, wherein the crossover sub window alignment assembly comprises an outer housing defining a fluid chamber, an actuator housing defining an actuator housing chamber, the actuator housing having at least one port placing the fluid chamber in fluid communication with the actuator housing chamber, the actuator being disposed within the actuator housing.

13. The fracturing tool of claim 12, wherein the actuator further comprises a return member.

14. The fracturing tool of claim 12, wherein the crossover sub window alignment assembly further comprises a rotation mechanism operatively associated with the actuator.

15. The fracturing tool of claim 14, wherein the rotation mechanism comprises a J-hook mechanism.

16. The fracturing tool of claim 15, wherein the rotation mechanism further comprises a shaft in sliding engagement with an inner wall surface of the isolation sleeve bore, and the actuator is a piston head disposed at a lower end of the isolation sleeve, the piston head being in sliding engagement with an inner wall surface of the actuator housing.

17. A method of fracturing a wellbore, the method comprising the steps of:

(a) running a tubing string comprising a fracturing tool into the wellbore bore, the fracturing tool comprising at least two crossover sub-assemblies in fluid communication with each other, each of the at least two crossover sub-assemblies comprising a crossover bore and at least one window, an isolation sleeve disposed within the crossover bores of each of the crossover sub-assemblies, the isolation sleeve comprising an isolation sleeve bore and at least one isolation sleeve window, and a crossover sub window alignment assembly operatively associated with the isolation sleeve;

(b) pumping fluid through each of the at least two crossover sub-assemblies;

(c) actuating the crossover sub window alignment assembly thereby aligning at least one of the windows of the at least two crossover sub-assemblies with at least one isolation sleeve window to provide at least one opened fracturing fluid ejection path;

(d) pumping fracturing fluid through the isolation sleeve bore and out at least one opened fracturing fluid ejection path to fracture a first wellbore zone of the wellbore;

(f) reducing the fluid pressure being pumped through each of the crossover sub-assemblies;

(g) actuating the crossover sub window alignment assembly by applying fluid pressure to the crossover sub window alignment assembly causing the at least one opened fracturing fluid ejection path to close and at least one additional window of the at least two crossover sub-assemblies to be aligned with at least one isolation sleeve window to provide at least one additional opened fracturing fluid ejection path; and (h) pumping fracturing fluid through the isolation sleeve bore and out the at least one additional opened fracturing fluid ejection path into the wellbore to fracture a second wellbore zone of the wellbore.

18. The method of claim 17, wherein during steps (b)-(h) are repeated at least one additional time to fracture at least one additional wellbore zone.

19. The method of claim 17, wherein steps (c) and (g) are performed by moving the isolation sleeve axially relative to each of the at least two crossover sub-assemblies.

20. The method of claim 19, wherein steps (c) and (g) are further performed by rotating the isolation sleeve relative to each of the at least two crossover sub-assemblies.

21. The method of claim 17, wherein steps (c) and (g) are performed by moving each of the at least two crossover sub-assemblies relative to the isolation sleeve.

22. The method of claim 17, wherein during step (c), the crossover sub window alignment assembly is actuated by applying fluid pressure to the crossover sub window alignment assembly as a result of step (b).

* * * * *